US005255552A

United States Patent [19]

Bielfeldt

[11] Patent Number: 5,255,552

[45] Date of Patent: Oct. 26, 1993

[54] HYDROELASTIC DEEP-DRAWING APPARATUS

[75] Inventor: Friedrich B. Bielfeldt, Eppingen, Fed. Rep. of Germany

[73] Assignee: Maschinenfabrik J. Dieffenbacher GmbH & Co., Eppingen, Fed. Rep. of Germany

[21] Appl. No.: 834,104

[22] Filed: Feb. 12, 1992

[30] Foreign Application Priority Data

Feb. 12, 1991 [DE] Fed. Rep. of Germany ..... 4104136

[51] Int. Cl.[5] ..... B21D 24/08

[52] U.S. Cl. ..... 72/351; 72/453.13

[58] Field of Search ..... 72/350, 351, 453.13; 267/119

[56] References Cited

U.S. PATENT DOCUMENTS 1,778,358 10/1930 Glasner ..... 72/351
1,970,134 8/1934 Ferris ..... 267/119

FOREIGN PATENT DOCUMENTS 0074421 9/1981 European Pat. Off. .
401534 12/1990 European Pat. Off. ..... 72/351
4016838 11/1991 Fed. Rep. of Germany .

*Primary Examiner*—Lowell A. Larson
*Attorney, Agent, or Firm*—Foley & Lardner

[57] ABSTRACT

A hydroelastic deep-drawing apparatus in presses for drawing sheet-metal shapes has a ram, a punch, a plurality of short-stroke cylinders, a plurality of drawing pins, a sheet-holder plate supported by the apparatus in relation to the plurality of short-stroke cylinders, a drawing die, a platen having a grid division thereon with a plurality of intersecting points, a plurality of hydraulic short-stroke pistons having multipoint control, each of the short-stroke pistons cooperating with a corresponding one of said plurality of short-stroke cylinders; a common die-cushion plate wherein the drawing pins are 1) arranged according to the geometry of said drawing-die at respective intersecting points of said grid division, and 2) supported on the common die-cushion plate via the short-stroke piston; and a position regulated and synchronous running differential cylinder/piston system which supports the die-cushion plate at its four outer corners. The plurality of short-stroke cylinders can be connected to create hydraulic force action zones according to the geometry of the sheet-holder plate or a workpiece and during the downward travel of the ram, starting at a predetermined coupling point, the die-cushion plate and the sheet-holder plate execute in the direction of the downward travel, a preliminary stroke while simultaneously maintaining a safety spacing between the ram and the sheet-holder plate. Additionally, subsequent to the preliminary stroke, the sheet-holder plate is raised a counterstroke distance relative to the die-cushion plate such that the workpiece is clamped in place; and subsequent to this, the ram executes a drawing operation relative to the punch during the completion of the downward travel of the ram. Thus, the impact shock to the workpiece is minimized.

16 Claims, 6 Drawing Sheets

HYDROELASTIC DEEP-DRAWING APPARATUS

BACKGROUND OF THE INVENTION

1. Field of the Invention

The invention relates to a hydroelastic deep-drawing apparatus in presses for the drawing of sheet-metal shapes, and more particularly to a hydroelastic deep-drawing apparatus having a ram, a punch, a plurality of short-stroke cylinders, a plurality of drawing pins, a sheet holder plate, a drawing-die, a platen, a plurality of short-stroke pistons, a die cushion-plate, and a differential cylinder/piston system.

2. Description of the Related Art

The object of German Patent No. 4,100,206 is that disadvantages of prior art deep-drawing devices are avoided while bringing about a computer-assisted process-controllable hydroelastic deep-drawing. The apparatus of the above-mentioned German patent has drawing pins, arranged according to the geometric shape of the workpiece and according to the hole pattern, which are activated in the sheet-holder plate action zone and the drawing-punch action zone such that an exact force-profile control, without disturbing amplitudes, is obtained, thereby achieving the advantages and effects of an elastomeric die-cushion system.

In the solution of the above-identified patent, the following is described:

a) a die-cushion plate which has a multi-point control according to the geometric shape of the workpieces provided, and within the die-cushion plate target points, corresponding to a grid spacing or hole pattern having the dimensions "a" and "b", are assigned a hydraulic short-stroke piston with attachable drawing pins, the stroke of the short-stroke piston being no more than 10 mm, b) each short-stroke piston is assigned a short-stroke cylinder with selectively connectable hydraulic force action zones according to the workpiece or the sheet-holder plate, c) the die-cushion plate is supported hydraulically at each of the four outer corners by a differential cylinder/piston system of regulated position and parallel run, and d) by an appropriate control of the multi-point position, and regulation of the differential cylinder/piston system, eccentric forces, occurring in the event of a changing surface force center of gravity in the force action zones, are automatically absorbed hydraulically.

The measures and features according to the invention make it possible, in particular, for a plurality of action zones of the sheet-holder plate and drawing punch, to achieve the advantage associated with the method of an elastomeric sheet-holder/die-cushion system, but also with the advantage and possibility of using a computer-assisted process control. The solution according to the aforementioned patent makes it possible to activate a plurality of hydraulic cylinders in a very confined space in a process-controllable and computer-assisted manner. That is to say, in an identically repeatable manner using the same program, without each individual cylinder having to be equipped with separately controlled valves.

Where deep-drawing presses are concerned, it is especially noticeable that a sharp and uncontrolled impact shock of the ram on the deep-drawing sheet (workpiece) has the following disadvantages:

that the lubricating-film texture applied to the sheet on both sides is damaged or even destroyed, and that impact markings, caused by the dynamic shock, leave their trace on the sheet and, even where shapes undergo less deep-drawing, as for example flat body parts, the impact markings persist as a marking on the deep-drawn shapes thereby requiring additional finishing measures, as for example the application of coats of enamel, so that they can be applied to finished parts-by.

According to the state of the art, in all drawing appliances, with or without force action zones, or even in four-point drawing systems, a passive non-positive connection with the sheet-holder plate is always obtained by the displacement of hydraulic oil which is counter to a pressurized valve.

In order to minimize the impact shock on the workpiece, European patent specification 0,074,421 discloses a technical solution in which the sheet-holder plate is preaccelerated to approximately a speed which is synchronous with the ram, by means of a servo-hydraulic device and a movement-cycle control integrated therein. Using this system, it is not possible to prevent a considerable residual impact from adversely acting on the workpiece.

It must be mentioned, as a disadvantage of the device and control according to European patent specification 0,074,421, that additional measures are needed to reduce the mass-dynamic impact shock. To be more precise, there has to be an additional hydraulic actuator which preaccelerates the total mass of the sheet-holder, together with the drawing appliance, by means of a very complex servo-hydraulic crank control. This entails the disadvantage that, at the moment of contact with the sheet, the ram, together with the drawing-die plate, must overtake the sheet-holder plate. As before, the total mass of the drawing appliance has to be accelerated according to the differential speed $\Delta V$. This dynamic "residual impact" will always be too high. In all events, these forces are equal to or higher than the hydraulic pressure surges which occur in an unreliable way in such hydraulic drawing appliances.

SUMMARY OF THE INVENTION

The object of the present invention is to improve the deep-drawing apparatus of the type described above in such a way that the impact shock on the workpiece is prevented. In particular, the object of the invention is to:

a) from the beginning to the end of the deep-drawing operation, to execute an exact process control such that the sheet-holding forces are to be controlled in the region of the drawing-die geometry "proportionally to the desired value", that is to say, without force peaks in the control trend over the deep-drawing stroke, b) during the deep-drawing operation, the sheet-holding forces can be regulated from $P=0$ to $P=\max.$ (kN), without an interruption of the ram movement, and c) the impact speed is reduced until, in order to avoid uncontrolled masses and therefore force effects, the possibility of a passive nonpositive connection between the ram and drawing appliance by way of the workpiece is reliably prevented.

The above objects are met by providing a hydroelastic deep-drawing apparatus in presses for drawing sheet-metal shapes having: a ram; a punch; a plurality of short-stroke cylinders; a plurality of drawing pins; a sheet-holder plate supported by the apparatus in relation to the plurality of short-stroke cylinders; a drawing die; a platen having a grid division thereon with a plurality of intersecting points; a plurality of hydraulic short-stroke pistons having multipoint control, each of the short-stroke pistons cooperating with a corresponding one of the plurality of short-stroke cylinders; a common die-cushion plate in which the drawing pins are 1) arranged according to the geometry of the drawing-die at respective intersecting points of the grid division, and 2) supported on the common die-cushion plate via the short-stroke piston; a position regulated and synchronous running differential cylinder/piston system which supports the die-cushion plate at its four outer corners. Moreover, in the apparatus, the plurality of short-stroke cylinders can be connected to create hydraulic force action zones according to the sheet-holder plate or a workpiece, and during the downward travel of the ram, and starting at a predetermined coupling point, the die-cushion plate and the sheet-holder plate execute in the direction of the downward travel a preliminary stroke while simultaneously maintaining a safety spacing between the ram and the sheet-holder plate. Furthermore, subsequent to the preliminary stroke, the sheet-holder plate is raised a counterstroke distance, relative to the die-cushion plate, such that the workpiece is clamped in place, and subsequent to the workpiece being clamped in place, the ram executes a drawing operation relative to the punch during the completion of the downward travel of the ram.

It is considered a decisive advantage over the state of the art that, during the impact of the ram, the non-positive connection with the drawing appliance is made not by way of the workpiece, but directly via the ram. In only this manner can a dynamic residual shock on the workpiece be prevented in a functionally reliable way.

In particular, the non-positive connection is made by means of an overtaking or dragging operation by the ram itself in the course of the electronic or mechanical free-wheel transmission according to the invention. There is no need for any preacceleration in order to prevent the impact shock on the workpiece. These forces, which act as a dynamic impact shock, take effect directly between the ram and an impact point of the drawing appliance, but never on the deep-drawing sheet itself.

Electronic coupling has proved to be a simple solution principle because the hydraulic drawing appliance is taken up directly by the ram by means of an electronic drag system, and the sheet-holder plate automatically follows the speed trend, as for example, a sine characteristic in a crank press.

Furthermore, the advantages of the solution according to the invention include the fact that, in the course of a free-wheel effect on one side, during the upward movement of the ram, an independently operating system effects, for example, the resetting of the drawing appliance by means of the actuators, and any intermediate distance position, as required for example for ejector operations and/or transfer positions of a transfer device, can be selected in a speed- and position-regulated manner.

It must be mentioned that an advantage of a mechanical coupling, as compared with an electronic coupling, is that at $\Delta x$=constant, a control deviation corresponding to a tilting on the die-cushion plate cannot occur in view of the preprogrammed higher pressurizing force in the hydraulic supporting system because the oil compressibility is compensated for by the hydraulic pressurization, and a constant bearing against the mechanical stop is safely guaranteed. Furthermore, as a result of the mechanical synchronization of the die-cushion plate with the spacing $\Delta x$=constant, the super-posed force regulation, by means of the multipoint short-stroke cylinders in the servo-hydraulic control, is extremely rapid because the short-stroke cylinders have a very small oil volume and scarcely any oil compressibilities have to be compensated for servo-hydraulically.

Another important feature of the mechanical coupling is that the dynamic behavior, especially when used in mechanical crank presses, can be improved to an extremely large degree. Like $\Delta TH$ (=deep-drawing stroke), and $\Delta x$, $\Delta s$ (=safety spacing between the ram and sheet-holder plate) has a value which depends on the workpiece.

Further advantages of the invention are:

The dynamic reaction times are extremely short since the oil volume of the multipoint short-stroke system is smaller by a divisor $\geqq 20$ than that of all other hydraulic drawing appliances of whatever design. They are almost within the range of the switching times for the servo-hydraulic control valves $T \geqq 20$ ms.

The force-jump operating times are shorter by the divisor of two as compared to all previous hydraulic drawing appliances.

The control behavior which is strictly proportional to the desired value is advantageous especially when used in mechanical crank presses. This is because these type presses have very short force build-up times, in the millisecond range, in comparison with hydraulic presses.

BRIEF DESCRIPTION OF THE DRAWINGS

Other objects, features and advantages of the present invention will become apparent from the following detailed description and accompanying drawings wherein.

DETAILED DESCRIPTION OF THE PREFERRED EMBODIMENTS

Figure 1:
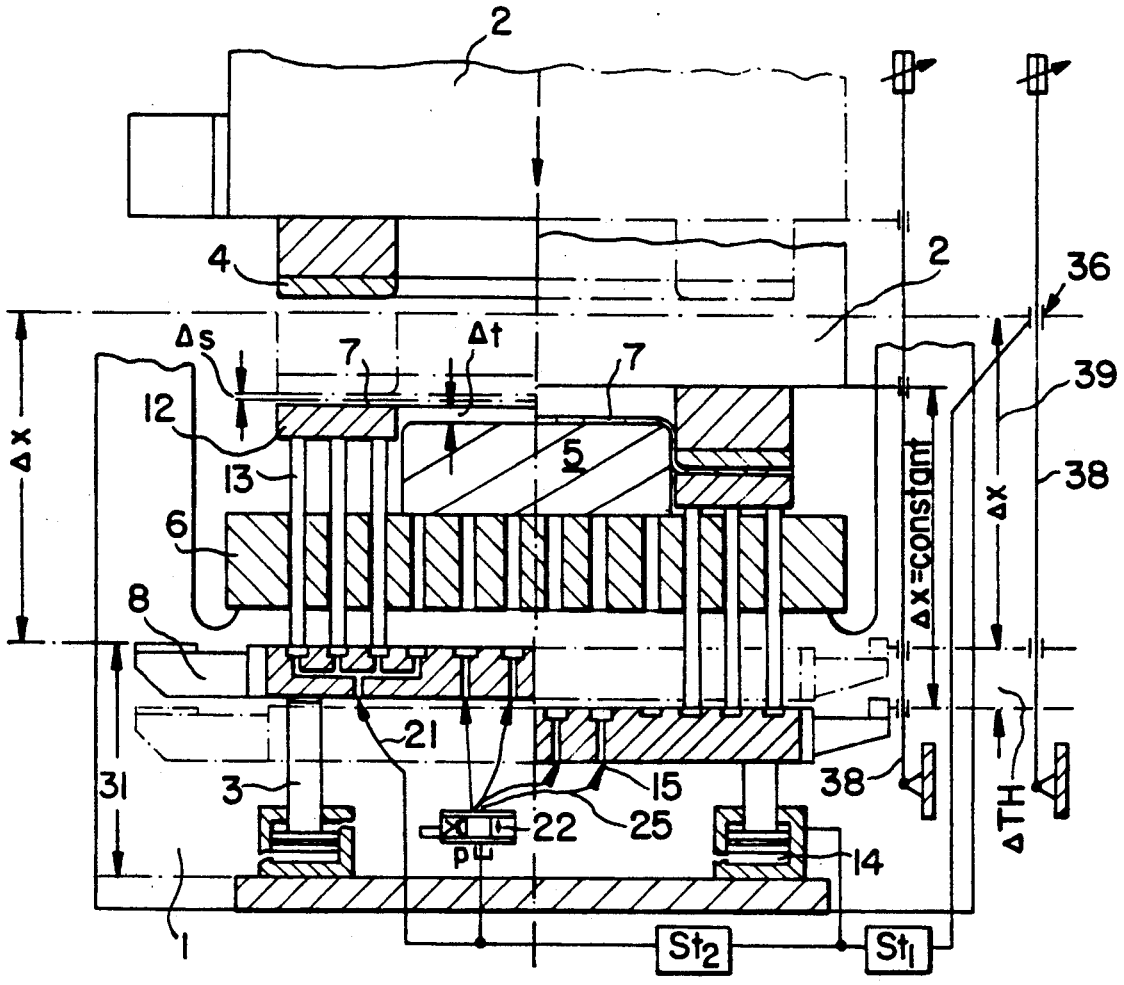
FIGS. 1 and 1*a* are diagrammatic representations of the deep-drawing apparatus according to the invention.
Figure 1A:
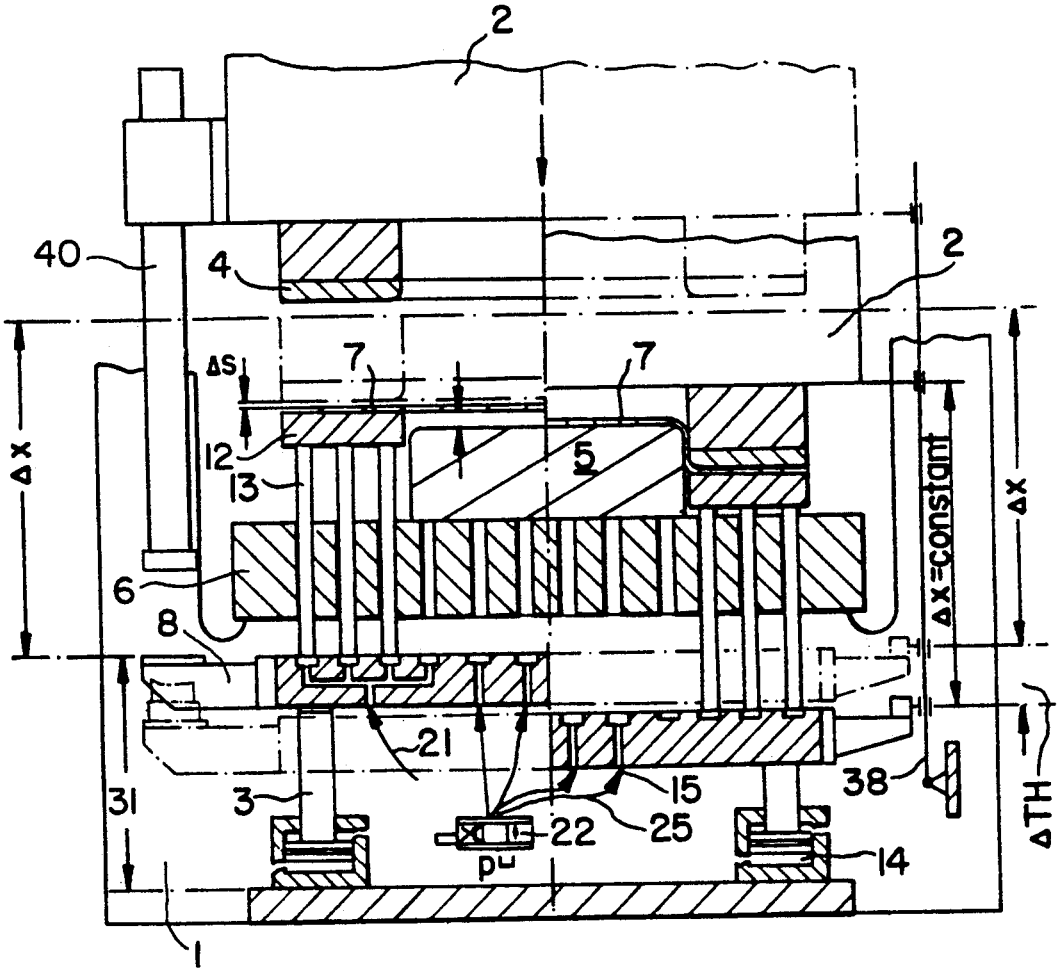
Figure 2A:
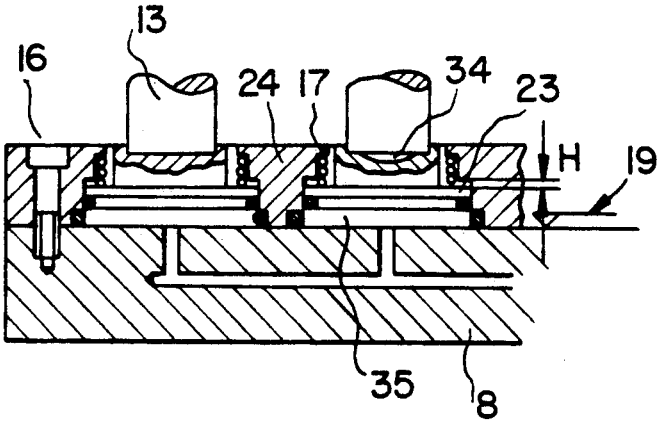
FIGS. 2*a* to 2*f* show the die-cushion plate according to FIGS. 1 and 1*a* on a larger scale.
Figure 2B:
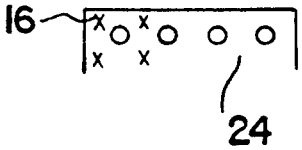
Figure 2C:
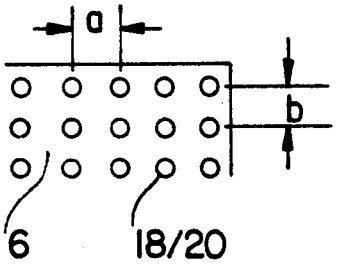
Figure 2D:
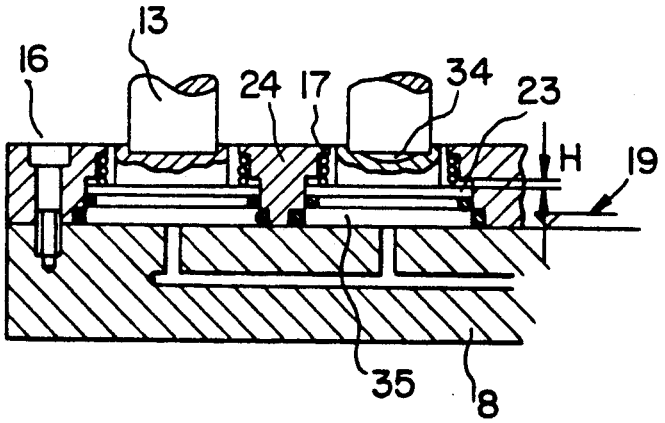
Figure 2E:
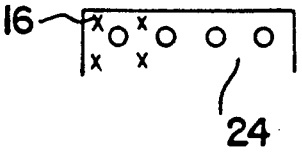
Figure 2F:
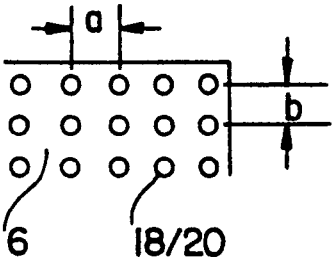

FIGS. 1 to 4*a* of the drawings show the deep-drawing apparatus in a press 1 partly in the open position and partly in the closed working position. The tool-change plate having the drawing die 4 is attached to the top spar having the ram 2.

The drawings also show the arrangement of a hydraulic die cushion 31 of a known conventional design, consisting of the mechanical drawing pins 13, which are arranged around the drawing-die geometry according to the grid division of the platen 6, and the die-cushion plate 8. The drawing pins are themselves supported on the common die-cushion plate 8, the die-cushion plate 8 being supported against four hydraulic actuators or supporting-cylinder/piston arrangements 3 and 14. These in turn are connected firmly to the baseplate 9 of the press frame. Hydraulic short-stroke piston/cylinder systems 10, 23 and 35 are provided for each drawing pin 13 in the die-cushion plate 8 in the spacings "a" and "b" according to the grid division. The stroke "H" each of the short-stroke pistons 10 and 23 amounts to only a few mm, as for example, at most, not greater than 10 mm. Each drawing pin 13 is supported on the short-stroke piston 10 or 23 and is mounted in a centering recess 34 of the short-stroke pistons 10 or 23. The short-stroke pistons 10 and 23 can be combined in force action zones 21 and 22, as for example for the sheet-holder plate 12 and/or the drawing punch 5, their connection being made via their cylinders 35 by means of fixed bores or pipes in the die-cushion plate 8 according to FIGS. 1 and 2.

The arrangement of the force action zones 21 and 22 underneath the die-cushion plate 8 can be selected as desired via external hydraulic force action zone blocks by means of flexible hoses 25 and plug connectors 15. The individual short-piston/cylinder systems can be combined according to their grid spacing "a" and "b" in an assembly plate 24, and individual assembly plates 24 can be arranged individually in larger grid divisions over the entire die-cushion surface. The fastening of the assembly plates 24 is carried out positively via screw connections 16 on the die-cushion plate 8. Each short-stroke piston 10, 23 and 35 is assigned return springs 17, so that the mechanical zero position is always on the die-cushion supporting surface 19 of the die-cushion plate 8, or so that the short-stroke pistons 10, 23 and 35 are held by means of the return spring 17 in a neutral mid-position for a plus/minus compensation. The die-cushion plate 8 is supported hydraulically at each of the four outer corners by means of a cylinder 14. During the deep-drawing stroke, all four cylinders are regulated servo-hydraulically by synchronous running (parallel run). These four parallel run regulated cylinders are preferably designed as differential pistons 3.

Figure 3:
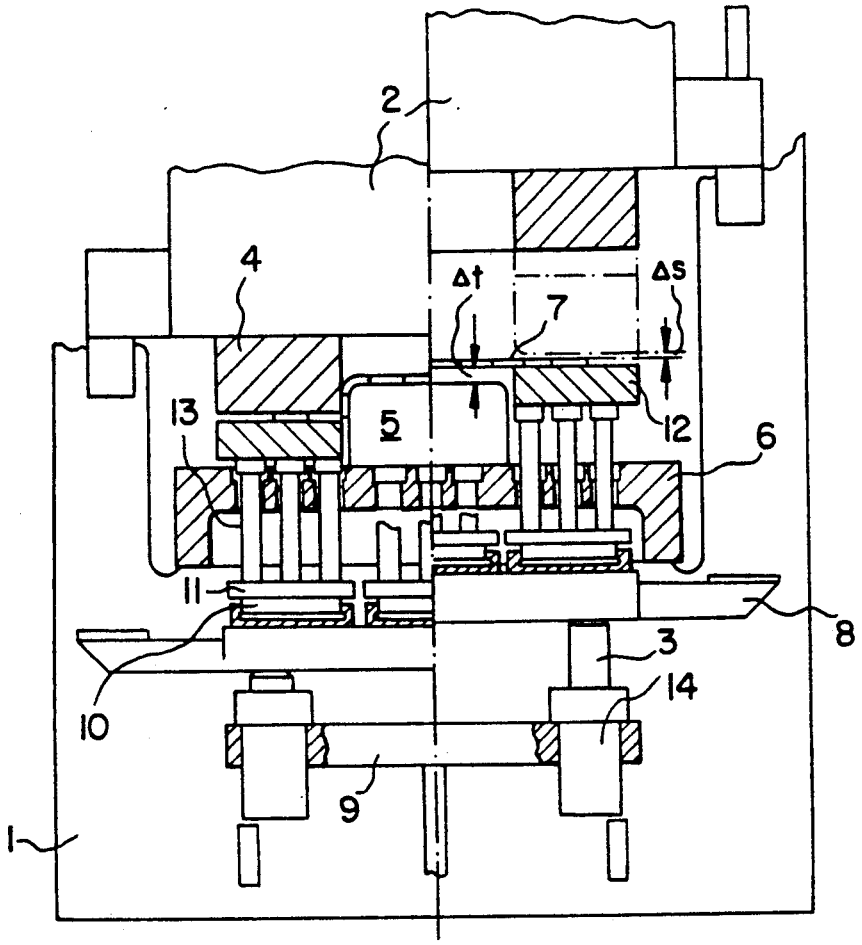
FIGS. 3 and 3*a* show the deep-drawing apparatus with the press closed and opened.
Figure 4:
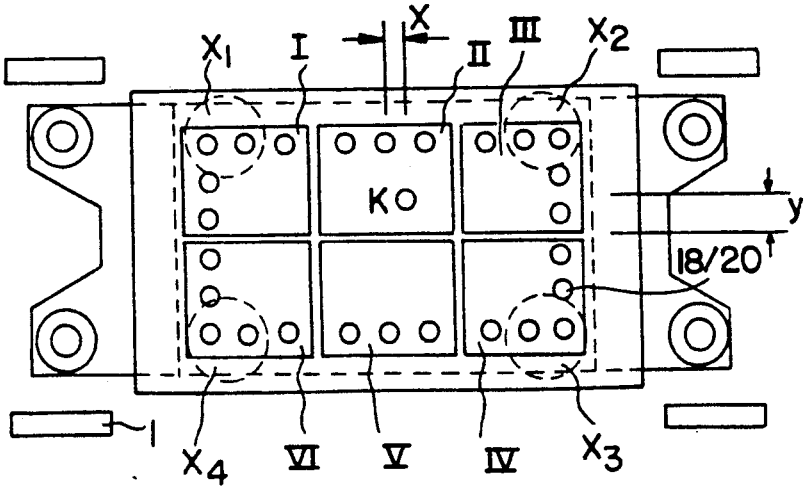
FIGS. 4 and 4*a* show the platen with the hole pattern according to FIGS. 1 and 1*a* and FIGS. 3 and 3*a*.

FIGS. 3 and 4 show a variation of the multipoint short-stroke piston/cylinder system, in which the mechanical drawing pins 13 are supported in groups, for example organized according to force action zones I to VI, on larger short-stroke pistons 10. The short-stroke pistons are each equipped with a rectangular supporting plate 11 for receiving a plurality of drawing pins 13. That is to say, instead of a plurality of short-stroke pistons 10 being spaced according to a small grid spacing "a" and "b" similar to that of FIG. 1, larger short-stroke piston units 10/11 are provided according to the force action zones.

The deep-drawing apparatus according to the invention functions as follows:

As shown in FIGS. 1 to 4, the electronic coupling takes place during the downward movement of the ram 2 to position 36. That is to say, from this point on, the die-cushion plate moves downwards, at a spacing where $\Delta x$ = a constant, in synchronous travel with the ram, this being known as a take-up function.

During the entire deep-drawing operation, the spacing $\Delta x$ = constant in relation to the ram movement is maintained. This applies both to a central hydraulic support or to a four-point support according to the hydraulic actuators 3 and 14. At the coupling point 36, the path position 39 of the die-cushion plate 8 is also activated by the path-measuring system 38 of the ram 2 via the path control $St_1$. That is to say, from position 36, the die-cushion plate 8 is automatically dragged along by the ram 2 by means of the electronic spacing $\Delta x$ = constant. With the four actuators 3 and 14 at the individual corners, the spacing $\Delta X_1$, $\Delta X_2$, $\Delta X_3$ and $\Delta X_4$ is maintained at the respective corners by electronic position regulation in synchronous travel with the ram 2. Via the central computer of the deep-drawing press 1, the coupling point 36 is selected in accordance with the tool geometry so that under no circumstances is there contact with the sheet by the drawing-die plate or the ram 2, and specifically, a safety spacing $\Delta s$ of 0.1 to 3 mm can appropriately be selected here. By means of the electronic coupling being in position 36, the hydraulic short-stroke cylinders 10 and 35, in the respective force action zones 21 and 22, are activated with a time delay via hydraulic servovalves by a time control $ST_2$ of minimum time delay, and by means of the drawing pins 13, the sheet 7 is pressed against the drawing die 4 via the sheet-holder plate 12. During the entire deep-drawing stroke $\Delta TH$, the short-stroke cylinders 35 are controlled actively in the respective force action zones, the respective force level per action zone being regulated via the ram 2 or the deep-drawing stroke $\Delta TH$ via the path-measuring system 38 of the ram 2 or of the sheet-holder plate 12 in terms of a force profile in accordance with the necessary process cycle. In principle, the mass-dynamic shock of the ram 2 on the workpiece is avoided. If the surface center of gravity K of force varies, in the event of a shift of the center of gravity K of force in the coordinate field $X_1$:$Y_1$, the eccentric force load is automatically absorbed in the course of the position regulation by the four synchronous cylinders 14. The control deviation occurring thereby is once again compensated for automatically by the short-stroke cylinders 35, the control deviation also being caused by the compressibility of the oil in the synchronous cylinders 14 in the event of a variation of the force profile during the deep-drawing stroke. Since the short-stroke cylinders 35 themselves have an extremely small oil volume, control deviations such as these can be compensated for in the course of the active control by means of supplying appropriate driving oil very quickly, as for example in a time of less than or equal to 45 mm/sec. That is to say, the system itself has a high dynamic reaction capacity.

The mechanical coupling according to FIGS. 1 to 4*a* functions as follows:

Instead of the electronic drag system previously described, in this case there is alternatively a mechanical take-up of the die-cushion plate 8 by the ram 2. At the four corner points of the ram 2, there are respective thrust rods 40 or threaded spindles which take up the die-cushion plate 8, starting from the coupling point 36, non-positively according to the ram speed. As soon as the mechanical thrust rods 40 drag the die-cushion plate 8 at the coupling point 36, the multipoint die-cushion system is hydraulically activated with a time delay via a time control "St". The multipoint short-stroke system 10, 11, 13, 23 and 35 in the force action zones 21 and 22 act non-positively by means of the drawing pins 13 on the sheet-holder plate 12 and workpiece 7, and raise them up against the underside of the drawing die 4. The die-cushion plate 8 in turn is supported against a central hydraulic actuator or a plurality of hydraulic actuator, as for example four hydraulic actuators 3 and 14 at the four corner points of the die-cushion plate. This supporting force corresponds to the sum of all the hydraulic forces actively generated in the force action zones 21 and 22. It is important to note within the meaning of the invention, that the sum force in the hydraulic supporting members 3 and 14 takes effect as a hydraulic pressurizing force with an amplification factor of 1.1–1.3. The compressibility of the hydraulic medium used is thereby compensated for in the actuators 3 and 14. It is also important that application of the increased pressurizing force leads the application of the sum force of the force action zones 21 and 22 in terms of time and distance during the deep-drawing stroke ΔTH.

Figure 3A:
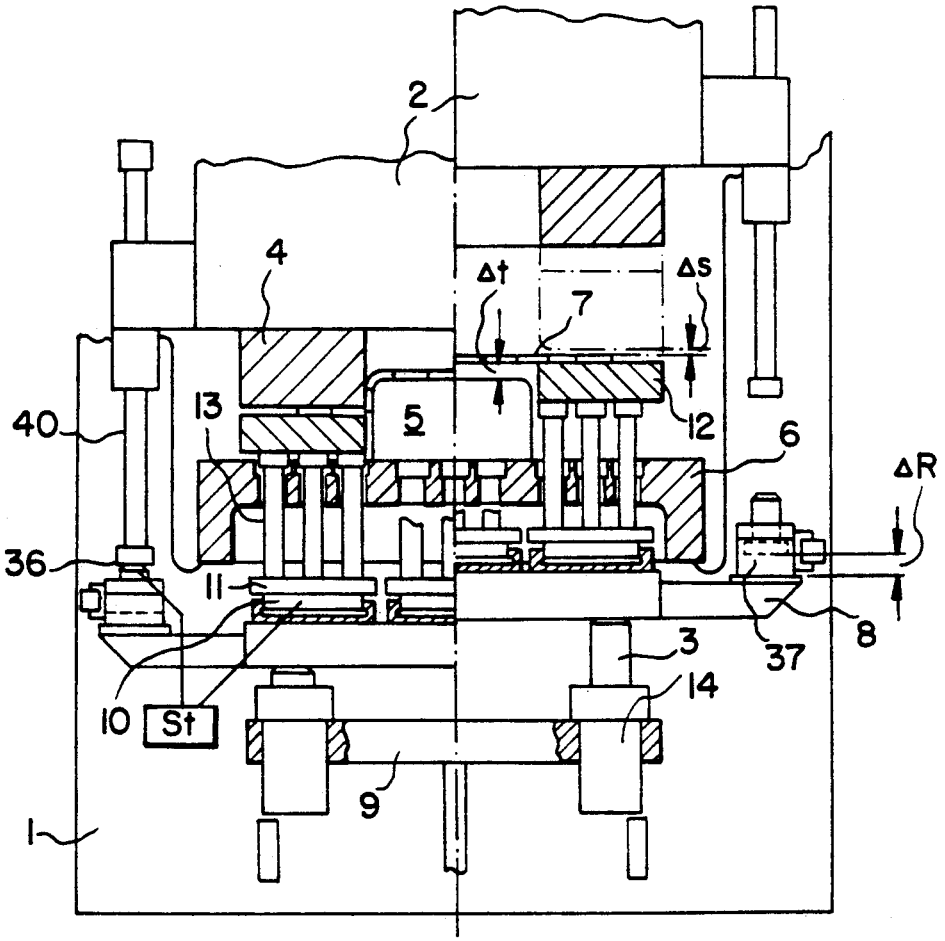
Figure 4A:
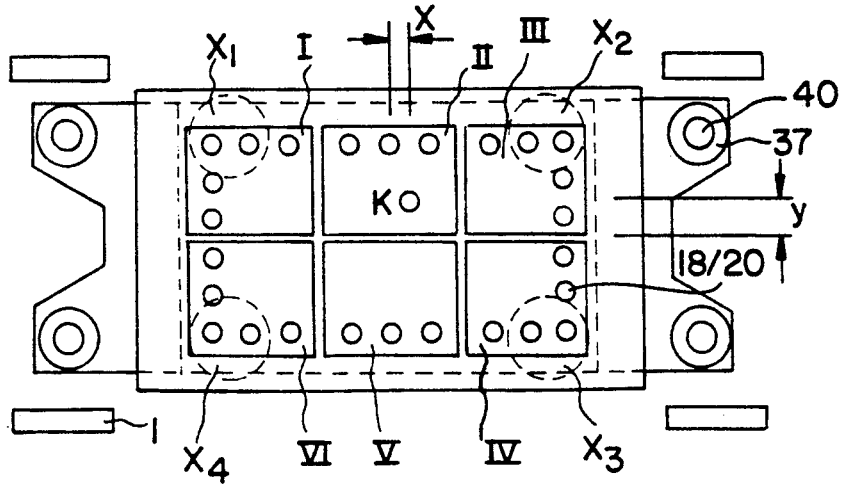

This lead time corresponds approximately to the switching time of the servo-hydraulic control or regulating system. When the mechanical drag system herein described is used at higher ram speeds, additional hydraulic damping elements 37 having a damping stroke ΔR can be employed (FIG. 3*a*) at the four respective corner points in order to prevent a mass-dynamic shock of the four thrust rods 40 on the die-cushion plate 8. These damping elements perform solely as a safety function, as for example:

to protect the thrust rods 40 against excessively high forces, or to minimize impact noises (mechanical knocking).

When the damping stroke ΔR has been covered, the drag travel or non-positive take-up of the die-cushion plate 8 by the ram 2 begins at the coupling point 36.

Because of the high downward speed of the ram 2, the preliminary stroke Δt must be substantially larger than the safety spacing Δs. A ratio of 20:1 to 30:1 is appropriately to be provided. The preliminary stroke Δt is measured from the lower edge of the deep-drawing sheet 7, when in a horizontal position, to the upper edge of the punch 5, and the safety spacing Δs is measured from the lower edge of the drawing die 4 to the upper edge of the deep-drawing sheet 7.

The sheet-holder plate 12 must have clamped the deep-drawing plate 7 against the drawing die 4 or the counterstroke Δs must be concluded before the ram 2 has covered the preliminary stroke Δt.

What is claimed is:

1. A hydroelastic deep-drawing apparatus for drawing sheet-metal shapes in presses, said apparatus comprising:

a ram;

a punch;

a plurality of short-stroke cylinders;

a plurality of drawing pins;

a sheet-holder plate supported by said apparatus in relation to said plurality of short-stroke cylinders;

a drawing die;

a platen having a grid division thereon with a plurality of intersecting points;

a plurality of hydraulic short-stroke pistons having multipoint control, each of said short-stroke pistons cooperating with a corresponding one of said plurality of short-stroke cylinders;

a common die-cushion plate wherein said drawing pins are 1) arranged according to the geometry of said drawing-die at respective intersecting points of said grid division, and 2) supported on said common die-cushion plate via said short-stroke pistons;

a position regulated and synchronous running differential cylinder/piston system which supports said die-cushion plate at its four outer corners;

means for interconnecting said plurality of short-stroke cylinders to create hydraulic force action zones according to the geometry of said sheet-holder plate or a workpiece;

means, during the downward travel of said ram and starting at a predetermined coupling point, for executing in the direction of said downward travel a preliminary stroke of said die cushion plate and said sheet-holder plate while simultaneously maintaining a safety spacing between said ram and said sheet-holder plate; and means, which are operative subsequent to said preliminary stroke, for raising said sheet-holder plate a counterstroke distance relative to said die-cushion plate such that the workpiece is clamped in place;

wherein subsequent to the workpiece being clamped in place, said ram executes a drawing operation relative to said punch during the completion of the downward travel of said ram.

2. The hydroelastic deep-drawing apparatus as claimed in claim 1, further comprising a time control and a path control which is dependent on the downward travel of said ram; wherein said differential cylinder/piston system comprises a plurality of supporting cylinders, each of said supporting cylinders being located at a respective one of outer corners of said die-cushion plate, said path control transmitting a signal to said supporting cylinders for the execution of said preliminary stroke, and said time control, subsequent to said preliminary stroke, actuating said short-stroke cylinders for raising said sheet-holder said counterstroke distance.

3. The hydroelastic deep-drawing apparatus as claimed in claim 1, further comprising a time control and a plurality of thrust rods, each of said thrust rods being located at a corresponding one of four corner points of said ram and being adjustable to the differing length of said apparatus, and wherein during the downward travel of said ram, when said coupling point is reached, said plurality of thrust rods non-positively take up the die-cushion plate in a drag travel according to the speed of said ram, and said time control subsequently actuates said short-stroke cylinders for raising said sheet-holder plate said counterstroke distance.

4. The hydroelastic deep-drawing apparatus as claimed in claim 3, further comprising a plurality of hydraulic damping elements, each of said hydraulic damping elements 1) having a damping stroke, 2) being mounted on said die-cushion plate and 3) acting as a stop for a corresponding one of said four thrust rods.

5. The hydroelastic deep-drawing apparatus as claimed in claim 3, wherein said differential cylinder/piston system comprises a plurality of supporting cylinders, each of said supporting cylinders being located at a respective one of outer corners of said die-cushion plate, the outer corners of said die-cushion plate being spaced a distance $\Delta X_1$, $\Delta X_2$, $\Delta X_3$ and $\Delta X_4$, respectively, from said ram, and said distances $\Delta X_1$, $\Delta X_2$, $\Delta X_3$ and $\Delta X_4$, being automatically maintained by said plurality of thrust rods.

6. The hydroelastic deep-drawing apparatus as claimed in claim 1, wherein said differential cylinder/piston system comprises a plurality of supporting cylinders, each of said supporting cylinders being located at a respective one of outer corners of said die-cushion plate, the outer corners of said die-cushion plate being spaced a distance $\Delta X_1$, $\Delta X_2$, $\Delta X_3$ and $\Delta X_4$, from said ram, respectively, and said distances $\Delta X_1$, $\Delta X_2$, $\Delta X_3$ and $\Delta X_4$, are maintained by electronically controlling said supporting cylinders in synchronization with the downward travel of said ram.

7. The hydroelastic deep-drawing apparatus as claimed in claim 1, wherein a safety spacing in a range of 0.1 to 3 mm is defined between said ram and said sheet-holder plate.

8. The hydroelastic deep-drawing apparatus as claimed in claim 1, wherein said differential cylinder/-piston system comprises a plurality of supporting pistons and a plurality of corresponding supporting cylinders, and during the upward movement of said ram, at intermediate distance positions for ejector and transfer devices and for transfer locations, said die-cushion plate can be reset in a speed and position regulated manner by said supporting pistons and said supporting cylinders.

9. The hydroelastic deep-drawing apparatus as claimed in claim 8, wherein said supporting cylinders and said supporting pistons produce a sum force which is set as a hydraulic pressurizing force having an amplification factor of 1.1–1.3.

10. The hydroelastic deep-drawing apparatus as claimed in claim 9, further comprising a control wherein during a deep-drawing stroke, application of said hydraulic pressurizing force leads the application of a total force, which is the sum of said force action zones, by a time which corresponds approximately to a switching time of said time control.

11. The hydroelastic deep-drawing apparatus as claimed in claim 1, wherein the ration of said preliminary stroke to said safety spacing is in a range of 20:1 to 30:1.

12. A method for drawing sheet-metal shapes in a press comprising the steps of:

(A) moving a ram downward;

(B) maintaining a spacing between said ram and a sheet-holder plate during the downward travel of said ram starting at a first predetermined point in the downward travel until a second predetermined point in the downward travel of said ram to complete a preliminary stroke;

(C) raising said sheet-holder plate in a direction opposite to the downward travel of said ram, after said preliminary stroke has been completed to clamp a workpiece in place; and (D) drawing the workpiece relative to a punch.

13. A method according to claim 12, wherein step (D) occurs subsequent to step (C).

14. A hydroelastic deep-drawing apparatus for drawing sheet-metal shapes in presses, said apparatus comprising:

a ram;

a punch;

a plurality of short-stroke cylinders;

a plurality of drawing pins;

a sheet-holder plate supported by said apparatus in relation to said plurality of short-stroke cylinders;

a drawing die;

a platen having a grid division thereon with a plurality of intersecting points;

a plurality of hydraulic short-stroke pistons having multipoint control, each of said short-stroke pistons cooperating with a corresponding one of said plurality of short-stroke cylinders;

a common die-cushion plate wherein said drawing pins are 1) arranged according to the geometry of said drawing-die at respective intersecting points of said grid division, and 2) supported on said common die-cushion plate via said short-stroke pistons;

a position regulated and synchronous running differential cylinder/piston system which supports said die-cushion plate at its four outer corners;

a time control; and a plurality of thrust rods;

wherein said plurality of short-stroke cylinders a re interconnected to create hydraulic force action zones according to the geometry of said sheet-holder plate or a workpiece;

wherein during the downward travel of said ram and starting at a predetermined coupling point, said die-cushion plate and said sheet-holder plate execute in the direction of said downward travel a preliminary stroke while simultaneously maintaining a safety spacing between said ram and said sheet-holder plate;

wherein subsequent to said preliminary stroke, said sheet-holder plate is raised a counterstroke distance relative to said die-cushion plate such that the workpiece is clamped in place;

wherein subsequent to the workpiece being clamped in place, said ram executes a drawing operation relative to said punch during the completion of the downward travel of said ram;

wherein each of said thrust rods are located at a corresponding one of four corner points of said ram and are adjustable to the differing length of said apparatus, sand wherein during the downward travel of said ram, when said coupling point is reached, said plurality of thrust rods non-positively take up the die-cushion plate in a drag travel according to the speed of said ram, and said time control subsequently actuates said short-stroke cylinders for raising said sheet-holder plate said counterstroke distance.

15. The hydroelastic deep-drawing apparatus as claimed in claim 14, further comprising a plurality of hydraulic damping elements, each of said hydraulic damping elements 1) having a damping stroke, 2) being mounted on said die-cushion plate and 3) acting as a stop for a corresponding one of said four thrust rods.

16. The hydroelastic deep-drawing apparatus as claimed in claim 14, wherein said differential cylinder/-piston system comprises a plurality of supporting cylinders, each of said supporting cylinders being located at a respective one of outer corners of said die-cushion plate, the outer corners of said die-cushion plate being spaced a distance $\Delta X_1$, $\Delta X_2$, $\Delta X_3$ and $\Delta X_4$, respectively from said ram, and said distances $\Delta X_1$, $\Delta X_2$, $\Delta X_3$ and $\Delta X_4$, being automatically maintained by said plurality of thrust rods.

* * * * *